US010450117B1

(12) United States Patent
Turner

(10) Patent No.: US 10,450,117 B1
(45) Date of Patent: Oct. 22, 2019

(54) DISPENSING CAPSULE

(71) Applicant: TRISTEL PLC, Snailwell, Newmarket (GB)

(72) Inventor: Jeremy Turner, Omorokoa (NZ)

(73) Assignee: TRISTEL PLC, Snailwell, Newmarket (GB)

( * ) Notice: Subject to any disclaimer, the term of this patent is extended or adjusted under 35 U.S.C. 154(b) by 42 days.

(21) Appl. No.: 15/765,872

(22) PCT Filed: Sep. 28, 2016

(86) PCT No.: PCT/GB2016/053021
§ 371 (c)(1),
(2) Date: Apr. 4, 2018

(87) PCT Pub. No.: WO2017/060677
PCT Pub. Date: Apr. 13, 2017

(30) Foreign Application Priority Data

Oct. 9, 2015 (GB) ..... 1517870.0

(51) Int. Cl.
*B65D 51/28* (2006.01)
*B65D 81/32* (2006.01)

(52) U.S. Cl.
CPC ..... *B65D 51/2835* (2013.01); *B65D 81/3283* (2013.01)

(58) Field of Classification Search
USPC ..... 206/219, 222
See application file for complete search history.

(56) References Cited

U.S. PATENT DOCUMENTS 6,644,471 B1 11/2003 Anderson
7,074,374 B1 7/2006 Fuji et al.
(Continued)

FOREIGN PATENT DOCUMENTS

EP 1810934 A1 7/2007
WO 02/22466 A1 3/2002
(Continued)

OTHER PUBLICATIONS

Steeman; "Developments in Dispensing Caps—An Overview"; Best in Packaging; ; Mar. 5, 2012; p. 1-10; https://bestinpackaging.com/2012/03/05/developments-in-dispensing-caps-an-overview/.

*Primary Examiner* — Jacob K Ackun
(74) *Attorney, Agent, or Firm* — Hayes Soloway PC

(57) ABSTRACT

A dispensing capsule (2) comprises a capsule body (4) having a first end (6) and a second end (8); a first cavity (14) and a second cavity (16) with a dividing member (18) between them within the capsule body (4), both cavities having an opening at the first end of the capsule body; a peripheral wall (24) at the first end (6) of the capsule body (4); and a flexible seal (30) bonded to the peripheral wall at the first end and to the dividing member so as to seal the contents of the first and second cavities from each other. The seal (30) is bonded less strongly to the dividing member (18) than to the peripheral wall (24). On an increase of pressure within the two cavities, the bond between the seal (30) and the dividing member (18) will eventually break, permitting the contents of the first cavity (14) to at least partly mix with the contents of the second cavity (16) while the bond between the seal (30) and the peripheral wall (24) remains intact. A burst pin (20,22) is also disposed within each cavity for breaking the bond between the seal (30) and at least some of the peripheral wall (24).

14 Claims, 15 Drawing Sheets

(56) References Cited

U.S. PATENT DOCUMENTS

| | | | | |
|---|---|---|---|---|
| 8,839,982 | B1 | 9/2014 | Anderson et al. | |
| 8,960,424 | B1 | 2/2015 | Anderson | |
| 9,132,950 | B1 | 9/2015 | Anderson et al. | |
| 2008/0142473 | A1 | 6/2008 | Cho | |
| 2010/0044377 | A1 | 2/2010 | Porter | |
| 2011/0174642 | A1 | 7/2011 | Coon | |
| 2011/0284402 | A1* | 11/2011 | Sharp | B65D 51/2835 206/222 |
| 2012/0012477 | A1 | 1/2012 | Latre | |
| 2012/0111744 | A1 | 5/2012 | Chen et al. | |
| 2012/0193362 | A1 | 8/2012 | Porter | |
| 2013/0193010 | A1 | 8/2013 | Muhlemann | |
| 2014/0117020 | A1 | 5/2014 | Seelhofer et al. | |
| 2014/0224797 | A1* | 8/2014 | Maloney | B65D 47/243 220/212 |
| 2015/0076012 | A1 | 3/2015 | Davis et al. | |
| 2015/0144656 | A1* | 5/2015 | Hamway | B65D 51/2842 222/83 |
| 2015/0329268 | A1* | 11/2015 | Duncan | B65D 81/3283 222/129 |
| 2016/0066749 | A1* | 3/2016 | Trager | A47J 43/27 206/222 |

FOREIGN PATENT DOCUMENTS

| | | | |
|---|---|---|---|
| WO | 2005/011756 | A1 | 2/2005 |
| WO | 2005/112634 | A2 | 12/2005 |
| WO | 2011/027177 | A1 | 3/2011 |
| WO | 2015/010176 | A1 | 1/2015 |

* cited by examiner

DISPENSING CAPSULE

BACKGROUND a. Field of the Invention

The present invention relates to a multi-chamber dispensing capsule, notably for dispensing a disinfectant composition.

b. Related Art

Many liquid preparations include active ingredients which degrade over time, limiting product shelf life. This is particularly true for disinfectants or sterilising agents such as chlorine dioxide, where the active ingredient is formed in situ when required by mixing two reagents. Examples are disclosed in WO 2005/011756. Chlorine dioxide, for example, may be formed by mixing a chlorite solution and an acid.

It is known to provide a dispensing capsule for location in the neck of a vessel, the capsule having two internal chambers, each containing a reagent. Discharging of the contents of the chambers into the vessel allows the reagents to mix and generate the active ingredient. Examples of such a dispensing capsule are described in U.S. Pat. No. 8,839,982. The dispensing capsule has two or more independently sealed and activated dispensing chambers each of which can contain a different substance to be dispensed into a primary chamber.

A problem with prior art dispensing capsule systems is that the capsule volume is typically small compared to the volume of the primary chamber. Accordingly, the reagents are present in a concentrated form and are dispensed into a diluent liquid such as water in the primary chamber. There may be a considerable delay between dispensing the contents of the chambers and generating an adequate concentration of active agent in the primary chamber. It is desirable to reduce or minimise this delay.

SUMMARY OF THE INVENTION

Aspects of the invention are specified in the independent claims. Preferred features are specified in the dependent claims.

The invention provides for at least partial pre-mixing of the contents of the chambers before the mixture is discharged into the primary chamber. This pre-mixing accelerates formation of the active agent and reduces or minimises any delay in formation of an adequate concentration of active agent in the primary chamber.

BRIEF DESCRIPTION OF THE DRAWINGS

The invention will now be further described, by way of example only, with reference to the following drawings in which.

DETAILED DESCRIPTION

Figure 1:
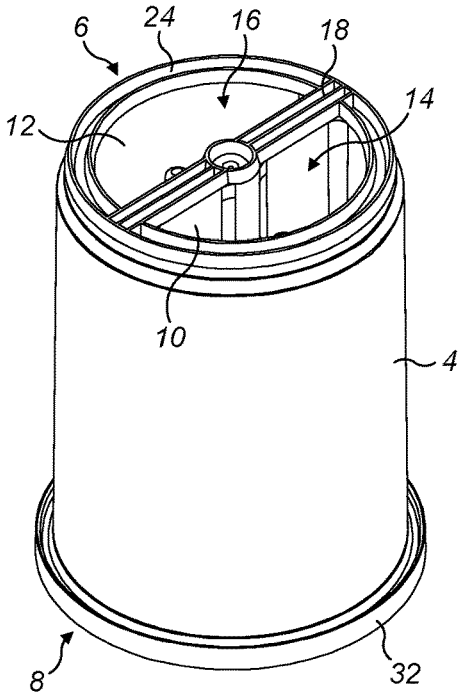
FIGS. 1 and 2 show views of a partial assembly of dispensing capsule in accordance with an embodiment of the present invention.
Figure 2:
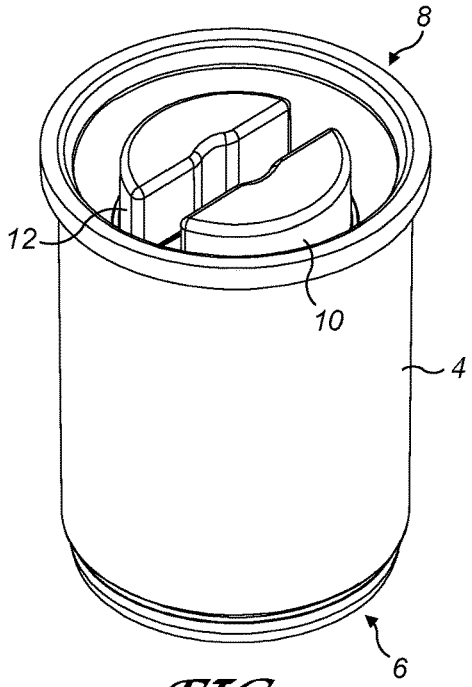
Figure 3:
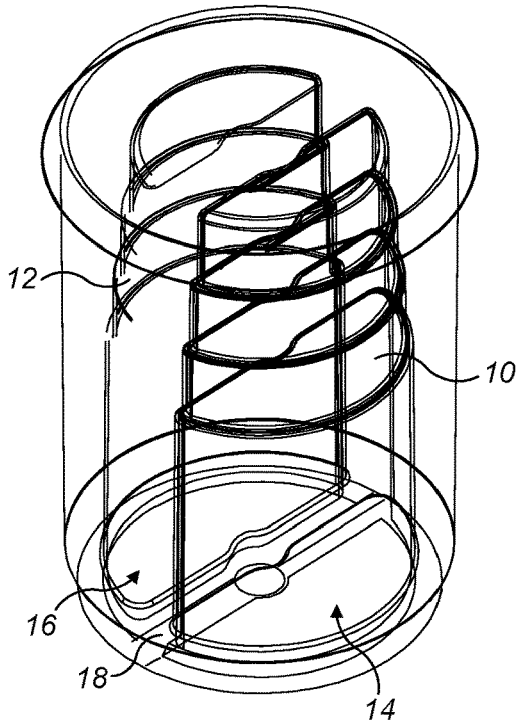
FIG. 3 is an x-ray view of the partial assembly of FIG. 2.
Figure 4:
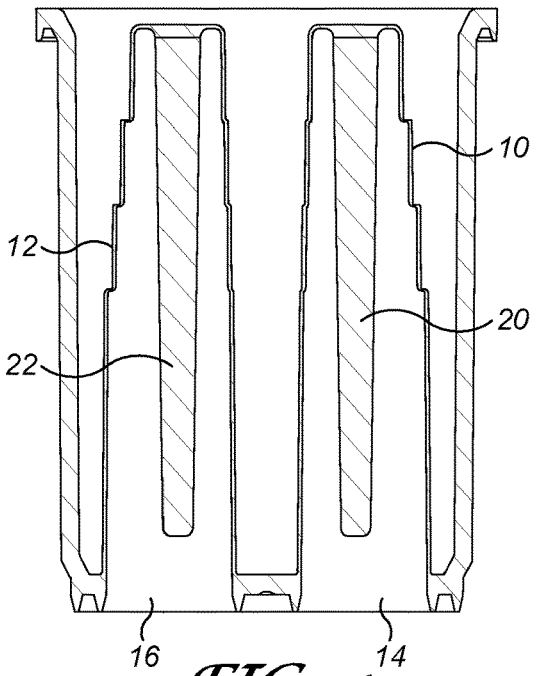
FIG. 4 is a central sectional view through the partial assembly of FIG. 2.

The partial assembly shown in FIGS. 1-4 comprises a capsule body 4 having a first end 6 and a second end 8. A first cavity 14 is defined within the capsule body 4 by at least a first wall 10, and a second cavity 16 is defined within the capsule body 4 by at least a second wall 12. A dividing member 18 is between the first cavity 14 and the second cavity 16. The dividing member 18 may be a common wall separating the cavities or it may be provided as an additional wall. The capsule body 4 has a peripheral wall 24 at the first end 6 and in this embodiment, a flange 32 at the second end. The cavities 14,16 each have a wall which is collapsible, concertina-style, as best shown in FIGS. 3 and 4. The first cavity 10 has a first burst pin 20 and the second cavity 12 has a second burst pin 22, as illustrated in FIG. 4.

Figure 5:
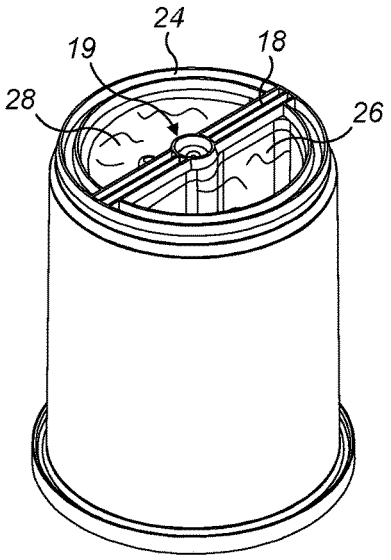
FIGS. 5-7 show stages in the manufacture of a dispensing capsule in accordance with an embodiment of the present invention.
Figure 6:
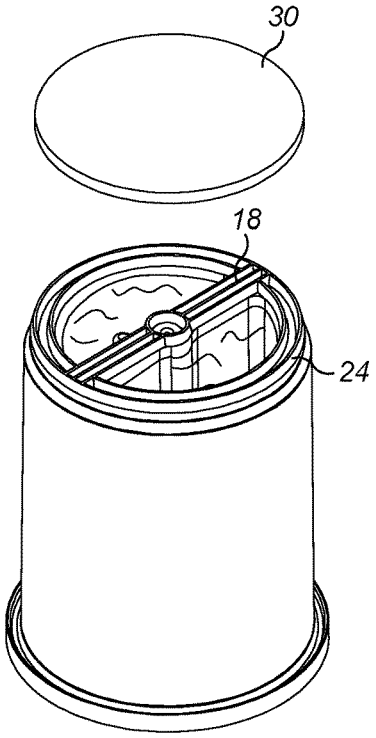
Figure 7:
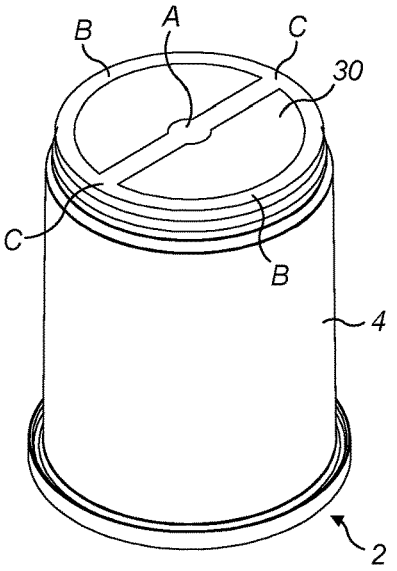

Referring now to FIGS. 5-7, stages in the manufacture of an exemplary dispensing capsule 2 are illustrated. The first cavity 14 is at least partly filled with a first fluid containing a first reagent 26, and the second cavity 16 is at least partly filled with a second fluid containing a second reagent 28. The term "fluid" is used herein to include liquids, pastes, aerosols, powders, sols and gels. The dividing member 18 in this embodiment has a depression or hollow region 19 corresponding to an injection point in the manufacture of the capsule body 4. A flexible seal 30 is bonded to the peripheral wall 24 at the first end of the capsule body 4, and to the dividing member 18 so as to seal the contents of the first cavity 14 from the contents of the second cavity 16. In this example, the seal 30 is welded to the peripheral wall 18 by an outer weld B and a retention weld region C-C (FIG. 7). A central weld region A is particularly weakly bonded because of the depression 19 where the seal 30 makes less contact with the underlying dividing member 18.

The seal 30 is plastically or elastically deformable under pressure. Suitable seal materials will be known to those skilled in the art. The seal 30 may, for example, be formed from a laminate of polyethylene (PE)/polyamide (PA)/ethylene-vinyl acetate (EVA) or PE/Aluminium/EVA. The capsule body 4 may be formed from any suitable structural material, notably a plastics material such as LDPE. The seal 30 may be bonded to the peripheral wall 24 and dividing member 18 by any suitable techniques; for example by welding or by means of an adhesive. Suitable adhesives and welding techniques will be well known to those skilled in the art.

Figure 8:
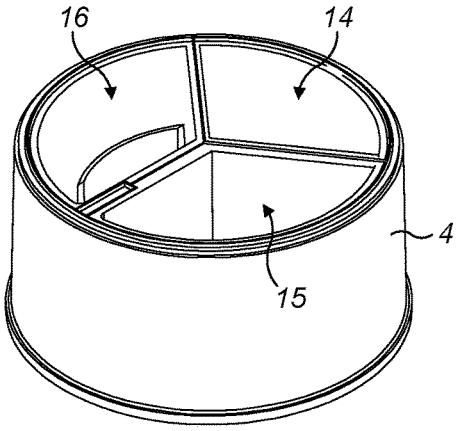
FIG. 8 illustrates a partial assembly for manufacturing a dispensing capsule in accordance with another embodiment of the invention.

It will be appreciated that the capsule body 4 may be of any size appropriate to its intended use, and may include more than two chambers. For example, the capsule body 4 shown in FIG. 8 is wider and shorter than the capsule body 4 of FIG. 1, and it includes a third cavity 15 in addition to the first cavity 14 and second cavity 16. The third cavity 15 may include a third fluid with a third reagent.

Figure 9:
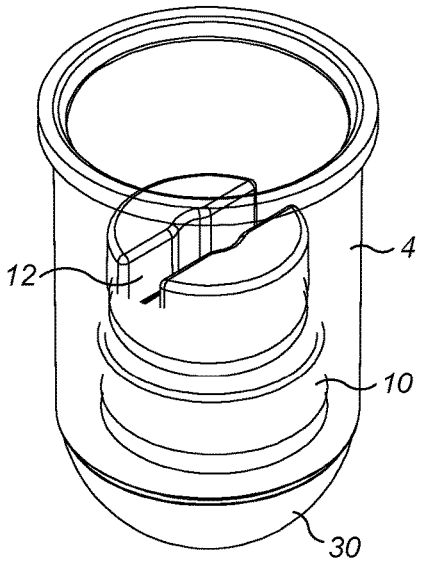
FIGS. 9-12 illustrate stages in the use of the dispensing capsule of FIG. 7.
Figure 10:
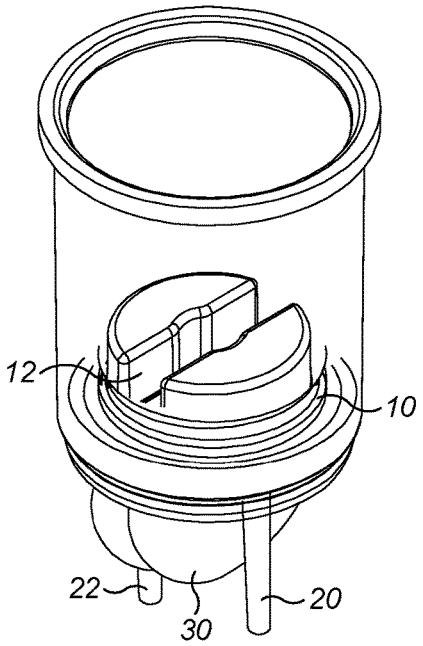
Figure 11:
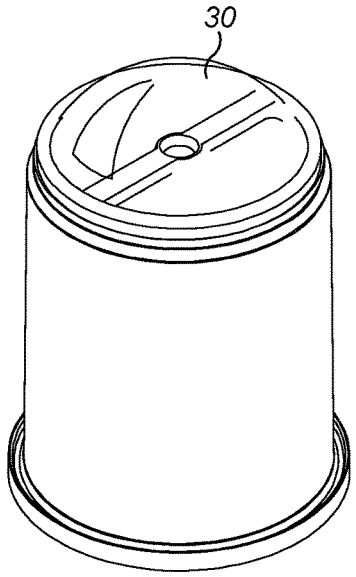

Referring now to FIGS. 9-12, stages in the use of the dispensing capsule 2 are illustrated. Application of pressure to the walls 10,12 of the cavities 14,16 causes the walls to progressively collapse concertina-style. If the pressure within the cavities is progressively increased, a critical pressure is reached at which the bond between the seal 30 and the dividing member 18 breaks, initially at the depression 19 which is the weakest point, allowing the seal 30 to be deformed into a dome (FIGS. 9 and 11). This deformation permits the contents of the first cavity 14 to at least partly mix with the contents of the second cavity 16 while the bond between the seal 30 and the peripheral wall 24 remains intact. The contents may, for example, be reagents which when mixed produce a disinfectant composition; for example chlorine dioxide or peracetic acid. Suitable reagents will be well known to those skilled in the art; for example, reagents for producing chlorine dioxide include: chlorite and acid; chlorate, peroxide and acid; and chlorite, hypochlorite, and a suitable buffer. The reagents may be in a concentrated form, providing rapid formation of the active agent when the contents of the chambers are mixed.

Figure 12:
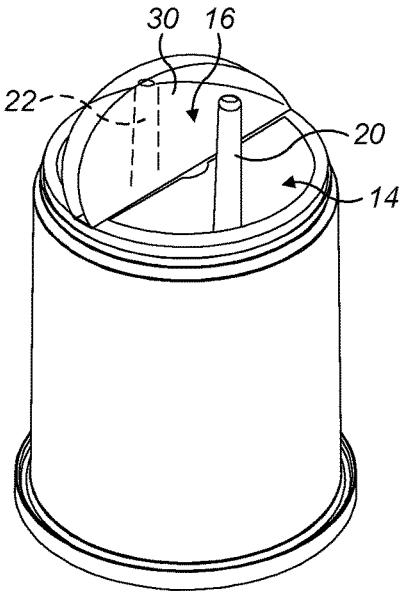

Increasing the pressure further collapses the walls 10,12 of the cavities 14,16, bringing the tips of the burst pins 20,22 into contact with the seal 30 and then pushing against the seal 30 so as to break the bond at the outer weld B (FIGS. 10 and 12). This preferred arrangement permits the premixed contents of the capsule body 4 to be dispensed in a controlled manner. However, one or more burst pins could alternatively cause rupturing of the seal 30, permitting the contents to emerge through a hole or tear in the seal. In an alternative embodiment, the increase in internal pressure within the capsule body may be sufficient to cause breaking of the seal or the bond between the seal and the peripheral wall without the use of burst pins.

Figure 13:
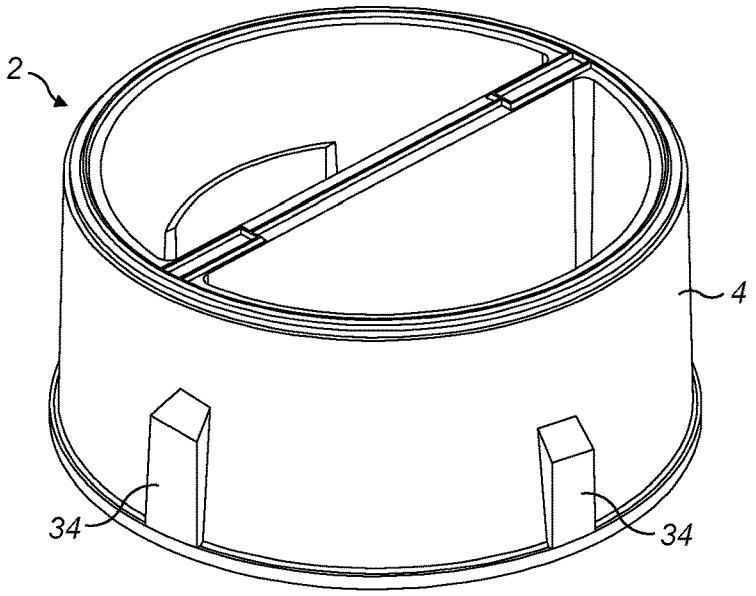
FIGS. 13-15 show a capsule body for use in alternative embodiments of the invention.
Figure 14:
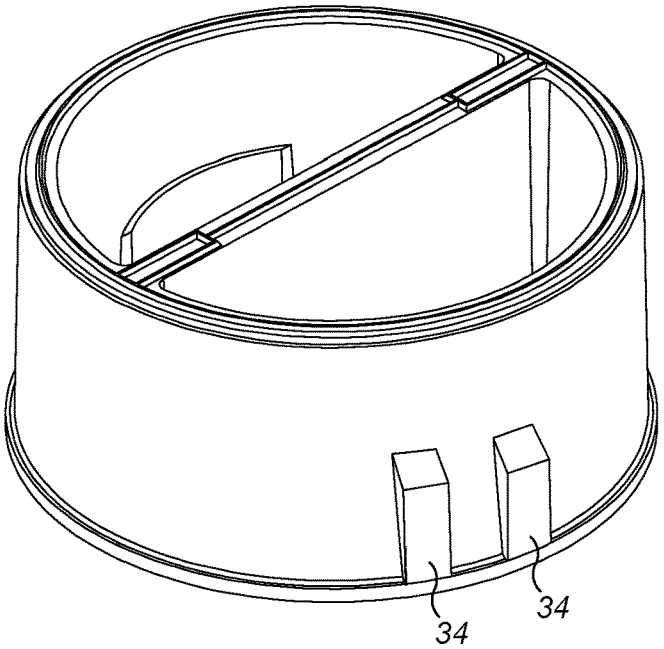
Figure 15:
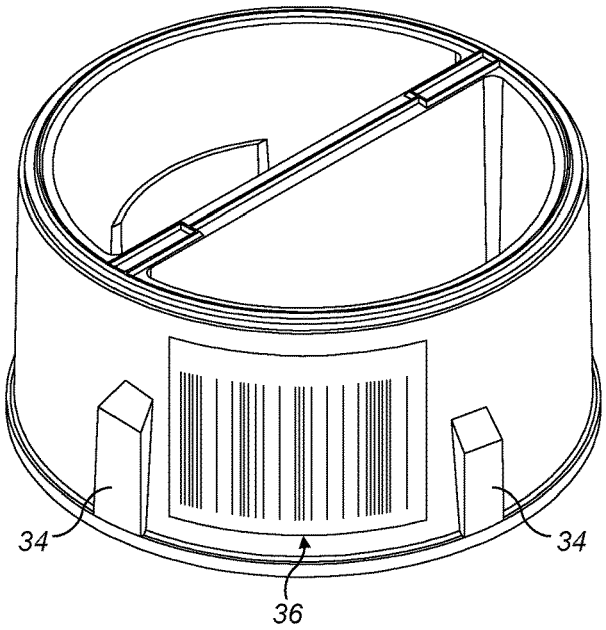

As illustrated in the embodiments of FIGS. 13-15, ribs 34 may be provided on the side of the capsule body 4. The ribs 34 act as a mechanical 'fingerprint' to identify the type or dose size carried by the dispensing capsule. The ribs 34 restrict or prevent the use of incorrect dispensing capsules by not permitting them to be engaged in a receiving portion of a vessel. The ribs 34 may also be used to mechanically activate the vessel to alert it to the type of capsule being used and what dose and vessel volume are to be filled. The ribs 34 may also be used to locate a bar code 36 (FIG. 15) that can be scanned by the vessel during the dispensing process. The bar code can also deliver information about the dispensing capsule for traceability and regulatory procedures.

Figure 16:
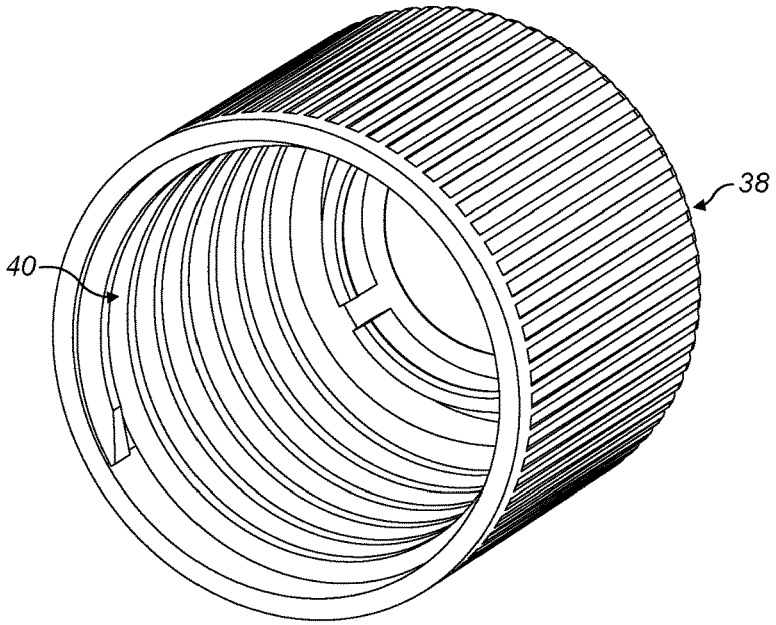
FIGS. 16-26 illustrate a cap assembly and stages in its use in an embodiment of the invention.
Figure 17:
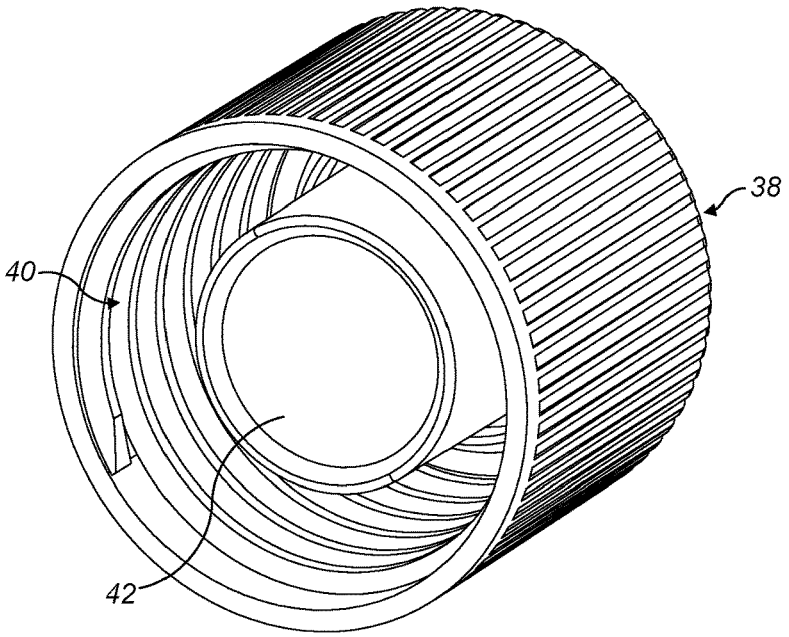
Figure 18:
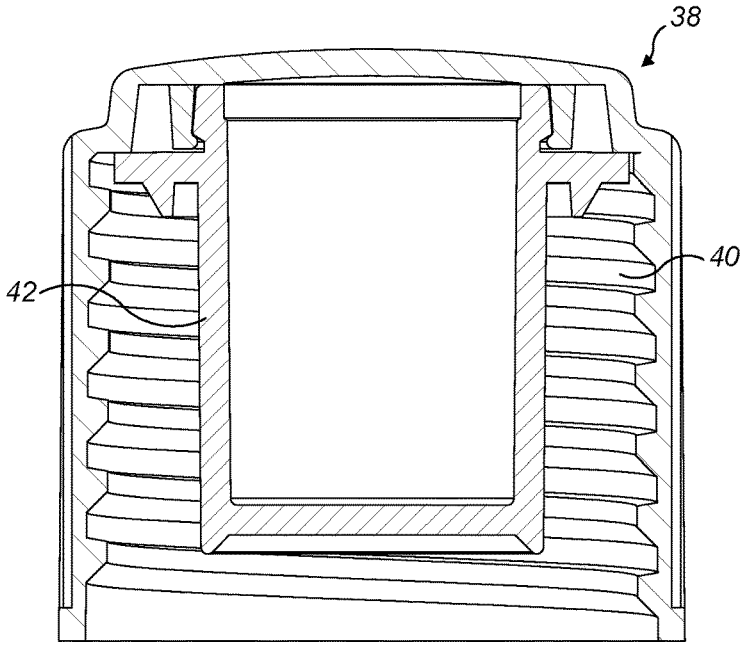
Figure 19:
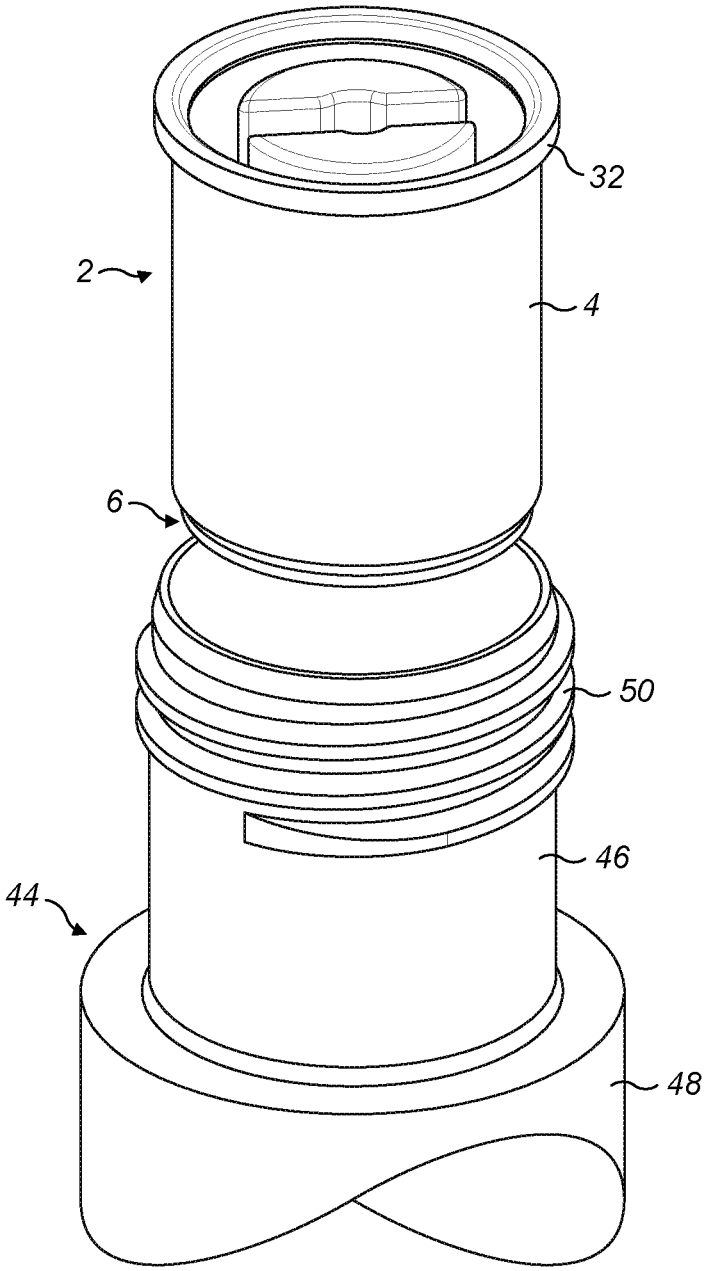
Figure 20:
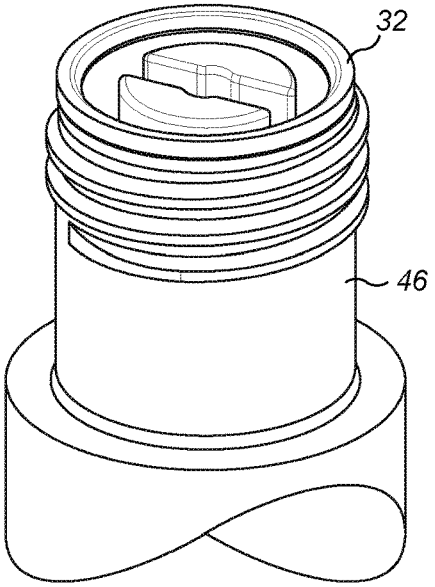
Figure 21:
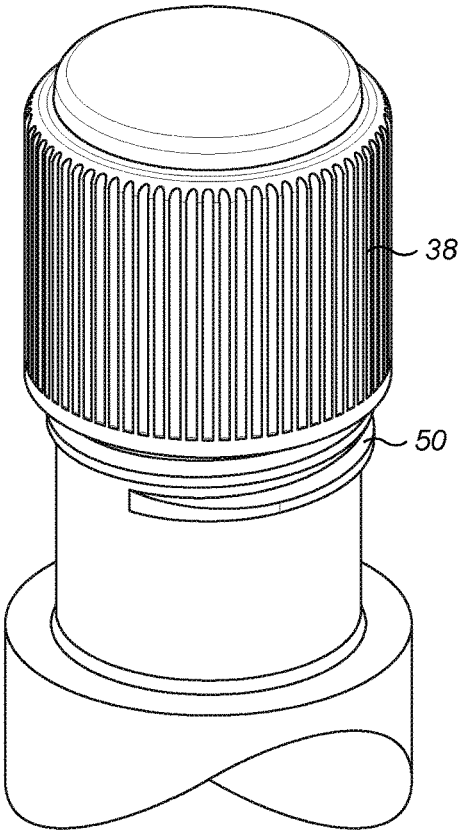

To apply force to the second (crush) end of the capsule body, a dedicated screw cap 38 (FIGS. 16-18) may be provided for use with the vessel. The cap 38 has an internal screw thread 40. Inside, a plunger 42 is attached which is able to rotate.

An implementation of the dispensing capsule in a vessel 44 is illustrated in FIGS. 19-26. The vessel 44 in this example is a bottle which has a neck 46 and a primary chamber 48. The neck 46 is provided with an external screw thread 50 which is complementary to the internal screw thread 40 on the cap 38. The capsule 2 is inserted into the neck 46, with the first (burst) end 6 innermost so that the seal 30 is in fluid communication with the primary chamber 48. The capsule body 4 is sized to be a close fit in the neck 46. When the capsule 2 is fully inserted, the flange 32 on the capsule body 4 sits on the rim of the neck 46 and a seal is created between the capsule 2 and the neck 46.

Figure 22:
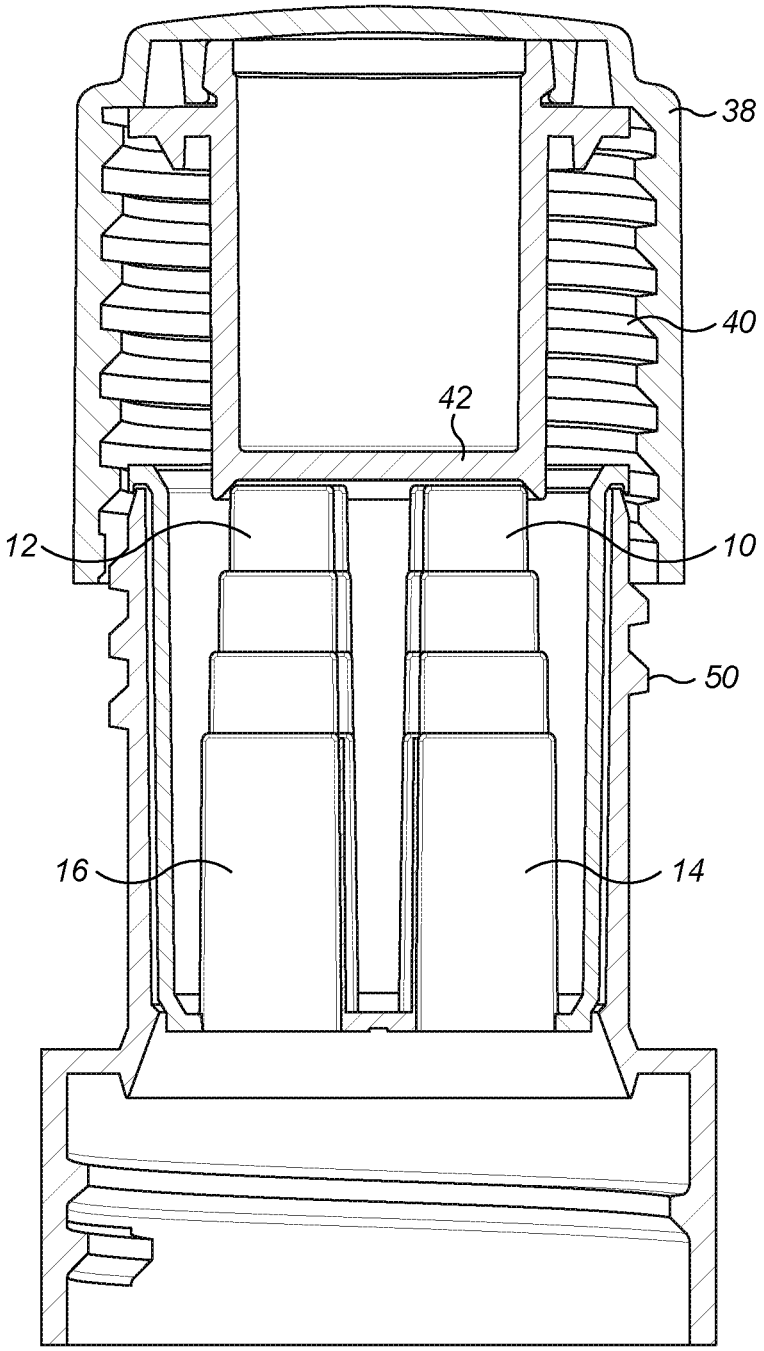
Figure 23:
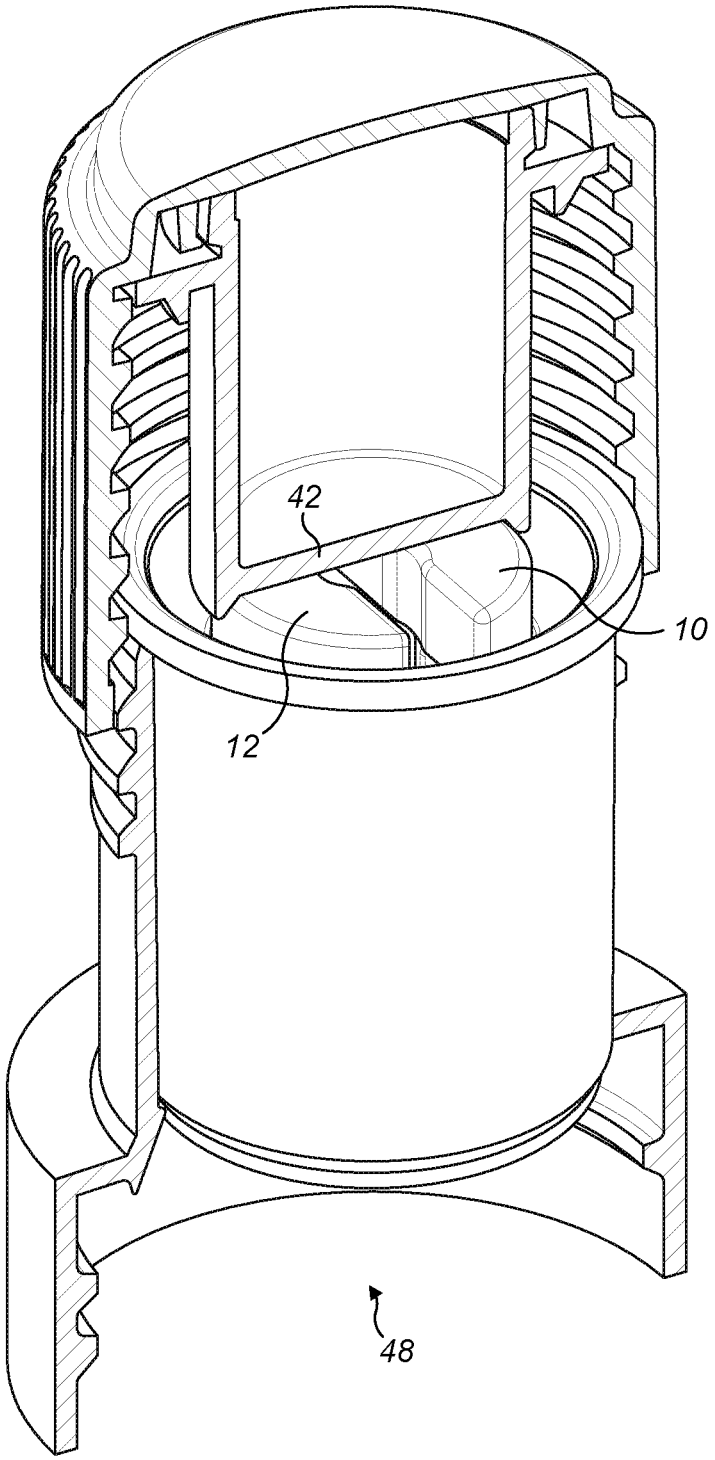
Figure 24:
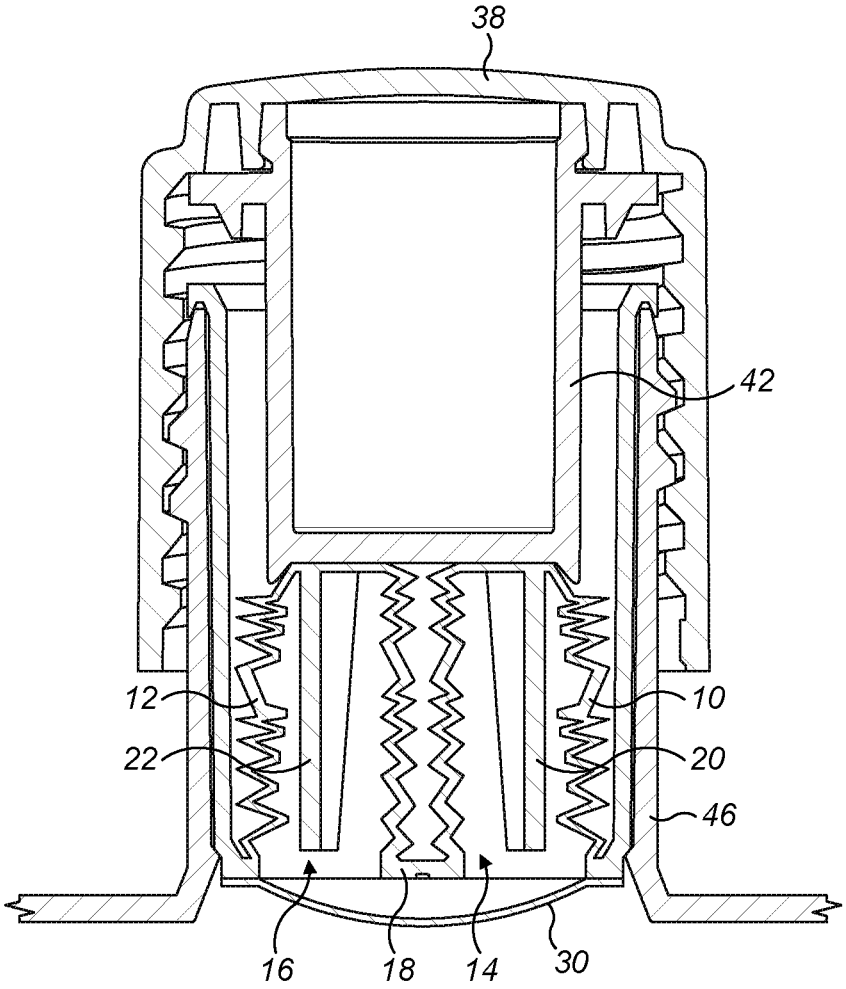
Figure 25:
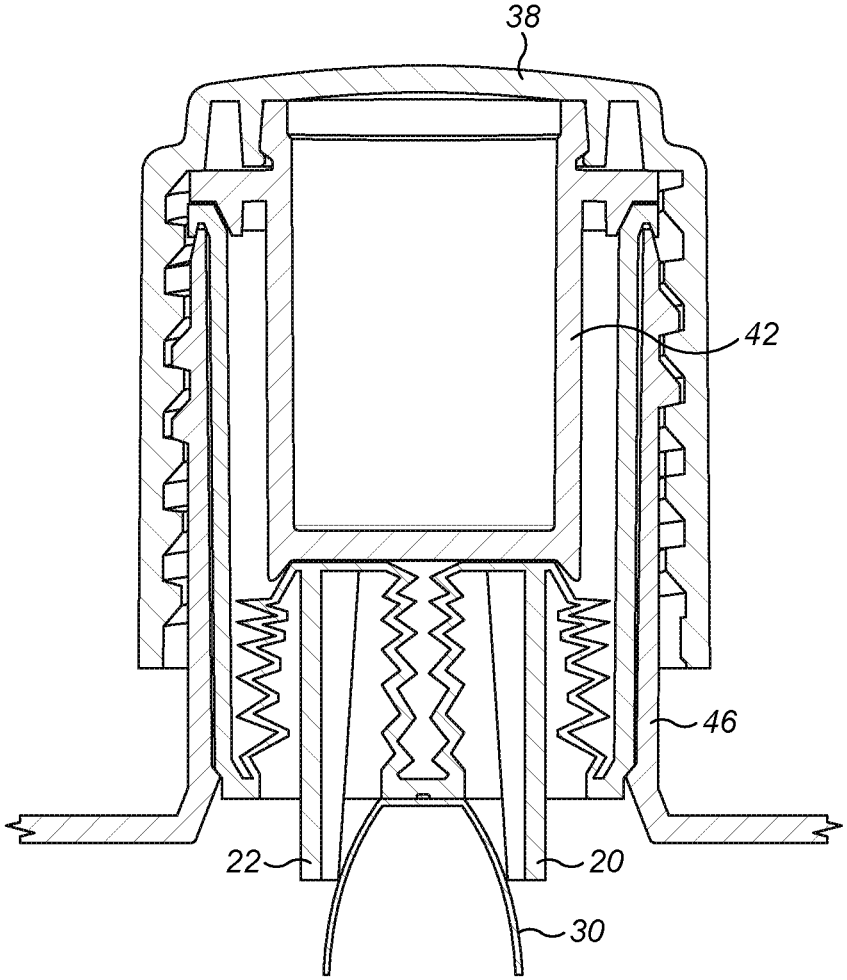
Figure 26:
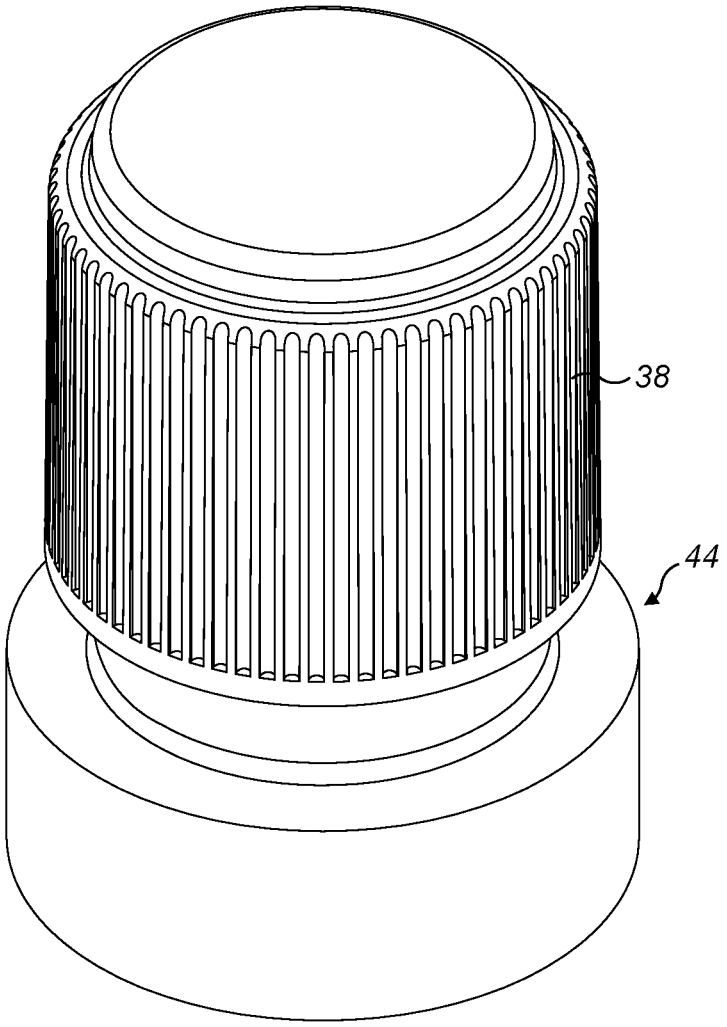

The cap 38 is then placed over the neck 46 of the vessel 44 and turned to engage the screw threads 40,50 with each other. When the cap 38 has been turned sufficiently, the plunger 42 is brought into engagement with walls 10,12 of the cavities 14,16 (FIGS. 22 and 23). Further turning of the cap 38 by the user advances the plunger 42 towards the first end of the capsule 2 and causes controlled collapsing of the walls 10,12 of the cavities 14,16. The collapsing of the walls increases pressure within the cavities 14,16. When a critical pressure is reached, the bond between the seal 30 and the dividing member 18 is broken (FIG. 24) allowing the contents of the first chamber 14 and second chamber 16 at least partly to mix while being retained within the peripheral boundary of the seal 30.

Still further turning of the cap 38 (FIGS. 25 and 26) advances the plunger 42 farther and causes the burst pins 20,22 to break the bond between the seal 30 and at least some of the peripheral wall 24, allowing the mixed contents of the capsule 2 to be dispensed into the primary chamber 48 of the vessel 44. Dispensing may be further facilitated by further turning of the cap 38 driving the plunger 42 down to displace the cavity area and force the mixture out of the capsule.

The primary chamber 48 contains a diluent liquid, for example water, into which the premixed concentrate from the capsule is dispensed. Because the concentrated reagents are at least partly mixed together before dilution, formation of the active agent is accelerated, thereby reducing or minimising any delay in formation of an adequate concentration of active agent in the primary chamber.

Figure 27:
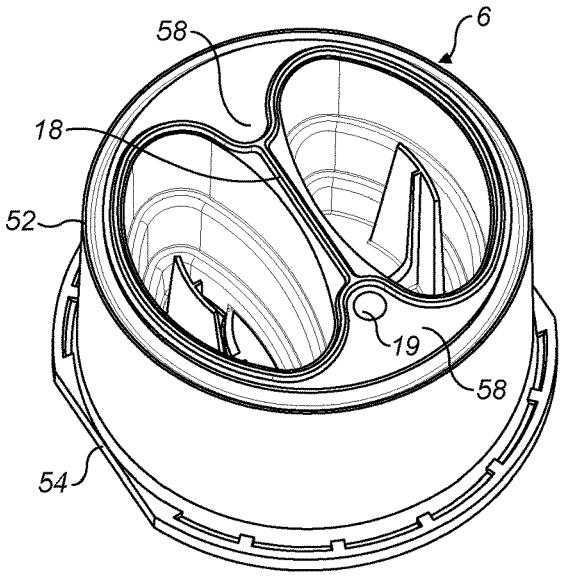
FIG. 27 shows another embodiment of the capsule body.
Figure 28:
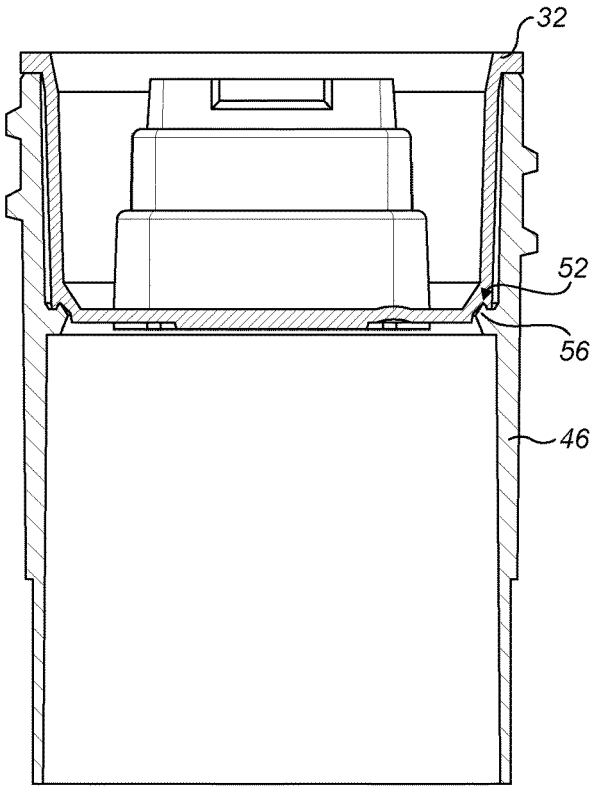
FIG. 28 shows the capsule body of FIG. 27 in the neck of a vessel.

Referring now to FIGS. 27 and 28, a further embodiment of a capsule body for use in the invention is shown. Here, the dividing member 18 is disposed between two internal projections 58 at the second end 6. The depression 19 is located on one of the projections 58. The capsule body has a production key detail 54 which is used to locate the capsule during filling and sealing operations. A sealing groove 52 is provided at the second end 6. The neck 46 of a vessel has an internal flange 56 onto which the sealing groove 52 locates when the capsule is inserted in the neck 46 of a vessel. The arrangement provides for improved sealing of the contents of the vessel both before and after dispensing of the contents of the capsule.

Experimental

Prototype capsule bodies similar to those shown in FIGS. 1-7 were formed from LDPE. Each capsule body was 35 mm deep and had a 26 mm external diameter at the first end and a 31 mm external diameter at the second end. The capsule outer wall was 1.2 mm thick. The internal walls defining the cavities were 0.5 mm thick and the cavities had a depth of 34 mm. Each cavity was filled with 3.5 ml of water and then sealed. The laminate seal was formed from PE (30 μm)/PA (30 μm)/EVA (40 μm) and was bonded to the first end by a hot-weld machine set at 135° C., for 3 seconds. Test results are given below.

1.0 Crush Force 1.1 Test Objectives

To determine that the proposed crush cycle operation is working correctly to first pre-mix the contents of the two cavities prior to being released from the capsule.

To determine the forces required to achieve this crush cycle and how these forces vary at various stages of this cycle.

To determine the effect that temperature may have on these forces.

1.2 Test Method a) A loaded capsule is fitted into a test neck jig with the cap plunger placed on top surface. The press is then centrally positioned. The scales read the force applied by the press onto the test assembly.

b) The force is recorded at three positions through the crush cycle c) The first 5 mm of plunger travel prior to any weld burst, both liquid filled cavities are still independently sealed. The seal is starting to bulge under the pressure applied d) The Pre Burst position is when the central weld has broken to allow the liquid contents of both cavities to mix—the seal has its maximum size bulge with the perimeter weld still fully attached e) The Release has the seal opened, at both cavities, from the burst pins driving through the seal during the final stage of the crush cycle—the seal has broken away from the weld to release the contents f) Samples were tested at various temperatures 1.3 Test Results Averages from test results are given in Table 1.

TABLE 1

| ° C. capsule Temp. | Kg 5 mm | Kg Pre Burst | Kg Release |
|---|---|---|---|
| 34 | 5 | 5.8 | 9 |
| 22 | 6 | 11 | 14 |
| 23 | 6 | 12 | 15 |
| 14 | 7 | 15 | 20 |
| 10 | 12 | 20 | 22 |

1.4 Summary

The results show that increased forces are required to complete the crush cycle when the capsule has a lower temperature. A limit may need to be placed on the temperature range to allow for correct operation of the capsule.

The capsule performed as expected completing the required weld burst function at each of the three stages of the cycle. The Pre Burst stage showed a clear detachment of the central weld that allowed the contents of the two cavities to fully mix prior to being released out of the capsule.

1.5 Conclusions

Temperature has an effect on the forces required to operate the capsule.

The forces required increase as the temperature lowers.

The capsule pre burst and release cycle is performing as required.

2.0 Crush Pressure 2.1 Test Objectives

To determine the amount of pressure that is being generated within the capsule during the crush cycle at the various stages. These results can then be used to help specify the limits of the weld retention.

2.2 Test Method a) An empty capsule is fitted into the test jig with the cap plunger assembled to the top surface. A press is applied to the test assembly. The pressure gauge is assembled to record the resulting pressure change.

b) The pressure is recorded at three positions through the crush cycle: 5 mm; Pre Burst; Release.

2.3 Test Results 2.4 Results are given in Table 2. The final column records that the finished Pre-Burst pressure held for 30 seconds, confirming that no leakage is occurring.

TABLE 2

| Pa 5 mm | Pa Pre Burst | Pa Release | 30 seconds Pressure |
|---|---|---|---|
| 2758 | 4137 | 5516 | held |
| 1379 | 3447 | 5516 | held |
| 1379 | 3447 | 5516 | held |
| 1379 | 3447 | 6205 | held |
| 1379 | 3447 | 5516 | held |
| 1379 | 3447 | 5516 | held |
| 1379 | 3447 | 5516 | held |
| 1379 | 3447 | 5516 | held |

2.5 Summary

The pressure levels shown are of a lower range which is easier to control. A pattern is evident from the results that suggest consistency has occurred. Weld strength can now be based on these pressures to determine the best burst results.

2.6 Conclusion

The consistency suggests the capsule is not leaking.

The crush effect produces a consistent pressure result through the cycle.

3.0 Screw Cap Torque 3.1 Test Objectives

To determine the torque levels being applied to the cap during the crush cycle at the various stages. The cap has to be user friendly so that the cap is easily screwed on during standard operation. Excess torque forces would require changes to the design to bring the forces to acceptable levels.

3.2 Test Method a) A loaded capsule is fitted into a test neck. The cap with plunger assembled is threaded onto the neck. A torque meter is attached to the top of the cap. Recordings are taken at the b) The lower torque levels recorded are based on best readings using the torque meter used.

c) The cap has a thread set at 5.5 turns per 20 mm for these tests.

d) The pressure is recorded at three positions through the crush cycle (described in 2.2 above): 5 mm; Pre Burst; Release.

3.3 Test Results are given in Table 3.

TABLE 3

| Nm 5 mm | Nm Pre Burst | Nm Release |
|---|---|---|
| 0.2 | 0.5 | 1.8 |
| 0.3 | 0.4 | 1.2 |
| 0.3 | 0.4 | 1.2 |
| 0.3 | 0.5 | 1.5 |
| 0.3 | 0.6 | 1.5 |
| 0.3 | 0.4 | 1.2 |
| 0.3 | 0.4 | 1.2 |
| 0.3 | 0.5 | 1.4 |
| 0.3 | 0.4 | 1.8 |
| 0.3 | 0.5 | 1.4 |
| 0.3 | 0.4 | 1.6 |
| 0.3 | 0.4 | 1.2 |
| 0.3 | 0.5 | 1.6 |
| 0.3 | 0.4 | 1.4 |
| 0.3 | 0.5 | 1.4 |

3.4 Conclusion

The current torque levels are well within an industry standard for comfortable ergonomic operation of the screw cap.

There is room to change the screw cap thread to reduce the number

The invention claimed is:

1. A dispensing capsule comprising a capsule body having a first end and a second end;

at least one wall defining a first cavity within the capsule body, the first cavity having an opening at the first end of the capsule body;

at least one wall defining a second cavity within the capsule body, the second cavity having an opening at the first end of the capsule body;

a dividing member between the first cavity and the second cavity;

a peripheral wall at the first end of the capsule body; and a flexible seal bonded to the peripheral wall at the first end of the capsule body and to the dividing member so as to seal the contents of the first cavity from the contents of the second cavity;

wherein the seal is bonded less strongly to the dividing member than to the peripheral wall such that if pressure within the first cavity and the second cavity is progressively increased, a critical pressure will be reached at which the bond between the seal and the dividing member will break, permitting the contents of the first cavity to at least partly mix with the contents of the second cavity while the bond between the seal and the peripheral wall remains intact;

further comprising a burst pin disposed within each of the first cavity and the second cavity, each burst pin having a tip which will press against the seal and cause breaking of the bond between the seal and at least some of the peripheral wall as pressure applied to the first cavity and the second cavity is progressively increased beyond the critical pressure.

2. A dispensing capsule according to claim 1, wherein a region of the dividing member to which the seal is bonded has a depression or hole which reduces the area of contact between the dividing member and the seal.

3. A dispensing capsule according to claim 2, wherein the dividing member is disposed between two internal projections at the second end, the depression or hole located on one of the projections.

4. A dispensing capsule according to claim 1, wherein the first cavity and the second cavity each has a wall which is collapsible concertina-style if pressure is applied to the cavities from the second end of the capsule body.

5. A dispensing capsule according to claim 1, wherein the first cavity contains a first reagent and the second cavity contains a second reagent, and wherein the first reagent and the second reagent react when mixed to produce a disinfectant or sterilising agent.

6. A dispensing capsule according to claim 1, wherein the capsule body is provided with at least two external ribs.

7. An assembly for dispensing liquids, the assembly comprising a vessel having a primary chamber and a neck in which is disposed a dispensing capsule according to claim 1; the seal in fluid communication with the primary chamber.

8. An assembly according to claim 7, wherein the neck includes an external screw thread; the vessel further including a cap having a complementary screw thread and a plunger which is disposed within the neck when the cap is fully engaged with the neck;

the arrangement being such that if the cap is screwed sufficiently far onto the neck, the plunger will initially be brought into contact with the walls of the first cavity and the second cavity through the second end of the capsule body, and will then progressively crush the walls of the first cavity and the second cavity until the critical pressure is reached.

9. An assembly according to claim 8, wherein further screwing of the cap onto the neck after the critical pressure has been reached will cause the plunger to further crush the walls of the cavities and cause each burst pin to break the bond between the seal and at least some of the peripheral wall.

10. An assembly according to claim 7, wherein the capsule body and the neck are each provided with at least one interengageable feature.

11. An assembly according to claim 10, wherein the capsule body is provided with two external ribs and the neck is provided with corresponding grooves for receiving the ribs.

12. An assembly according to claim 11, wherein the capsule body further comprises a bar code located between said two external ribs, the bar code encoding information about the dispensing capsule.

13. An assembly according to claim 12, further comprising a bar code scanner for reading information encoded by the bar code.

14. An assembly according to claim 7, wherein the capsule body is provided with an external sealing groove at the second end and wherein the neck of the vessel is provided with an internal flange onto which the sealing groove locates.

* * * * *